United States Patent [19]

Cookson

[11] 4,296,274

[45] Oct. 20, 1981

[54] HIGH VOLTAGE BUSHING HAVING WEATHERSHED AND SURROUNDING STRESS RELIEF COLLAR

[75] Inventor: Alan H. Cookson, Pittsburgh, Pa.

[73] Assignee: The United States of America as represented by the United States Department of Energy, Washington, D.C.

[21] Appl. No.: 167,501

[22] Filed: Jul. 11, 1980

[51] Int. Cl.[3] ..... H01B 17/26; H01B 17/42

[52] U.S. Cl. ..... 174/142; 174/31 R; 174/209

[58] Field of Search ..... 174/31 R, 142, 143, 174/152 R, 153 R, 167, 209

[56] References Cited

U.S. PATENT DOCUMENTS 3,544,707 12/1970 Gamble ..... 174/142

FOREIGN PATENT DOCUMENTS 69384 6/1941 Czechoslovakia ..... 174/152 R

*Primary Examiner*—Laramie E. Askin

*Attorney, Agent, or Firm*—Bruce E. Mansfield; Paul A. Gottlieb; Richard G. Besha

[57] ABSTRACT

A high voltage electric bushing comprises a hollow elongated dielectric weathershed which encloses a high voltage conductor. A collar formed of high voltage dielectric material is positioned over the weathershed and is bonded thereto by an interface material which precludes moisture-like contaminants from entering between the bonded portions. The collar is substantially thicker than the adjacent weathershed which it surrounds, providing relief of the electric stresses which would otherwise appear on the outer surface of the weathershed. The collar may include a conductive ring or capacitive foil to further relieve electric stresses experienced by the bushing.

12 Claims, 4 Drawing Figures

HIGH VOLTAGE BUSHING HAVING WEATHERSHED AND SURROUNDING STRESS RELIEF COLLAR

CONTRACTUAL ORIGIN OF THE INVENTION

The United States Government has rights in this invention pursuant to Contract No. EY-78-C-01-3107 between the U.S. Department of Energy and the Westinghouse Electric Corporation.

BACKGROUND OF THE INVENTION

The present invention pertains to high voltage electric bushings and, more particularly, to high voltage electric bushings of the gas insulated type. The bushing of this invention finds particular application in electrical systems operated at 500 KV and above. Various bushings for supporting high voltage conductors, and for controlling the electric field around such conductors, are known in the art. One design includes a hollow, elongated insulator or weathershed which houses an electric conductor coextensive therewith. When installed, one end of the weathershed is placed adjacent a grounded support surface, and the other end of the weathershed is placed adjacent portions of a high voltage electrical system which are connected to the conductor. Thus, voltage stress is imposed along the length of the weathershed, at its outer surface. It is important that the concentration of voltage stress at any point along the outside surface of the weathershed not exceed known maximum levels, above which failure of the weathershed is known to occur. Unfortunately, the electrical stress is not uniform throughout the length of the weathershed, but is concentrated at regions adjacent the base of the weathershed. Electrically conducting grounded shields, disposed between the conductor and the weathershed, have been proposed as one solution to relieve the high electrical stress adjacent the base of high voltage bushings. This does not, however, offer a satisfactory solution to the problem, since the point of maximum electrical stress experienced by the weathershed is merely displaced to a point where the ground shield is terminated, and the electrical stress concentrations imposed by operating voltages of 500 KV and above are not alleviated.

It has been known that electrical stress on the outside of the weathershed could be relieved if the outside surface of the weathershed could be further separated from the external conductor, as by increasing the internal diameter of the weathershed, or by increasing the wall thickness. Neither alternative offers a practical solution, as weathersheds having large internal diameters are prohibitively costly, as are very thick weathersheds having commercially feasible internal diameters.

It is therefore an object of the present invention to provide a high voltage bushing having improved voltage stress relief means.

Another object of the present invention is to provide an economical high voltage bushing having an enlarged outside diameter adjacent one end thereof to provide electric field stress relief.

It is another object of the present invention to provide a bushing having a weathershed of substantially constant thickness throughout its length.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

Briefly, a high voltage bushing is provided with a hollow, elongated weathershed formed of epoxy, ceramic, porcelain, or the like dielectric material. The weathershed houses a high voltage conductor which extends the entire length thereof. The weathershed, which is of substantially constant thickness throughout its length, receives a collar of substantially greater thickness at one end. The collar is formed of cast epoxy, ceramic, porcelain, or the like high voltage dielectric material, and when installed on the weathershed, imparts increased dielectric strength to the bushing. An interface material, disposed between the collar and the weathershed, provides bonding of the two members, as well as precluding moisture or the like contaminant from entering therebetween. The collar may include a conductive stress relief arrangement, such as a grounded shield, or capacitive foils disposed within its interior.

DETAILED DESCRIPTION OF THE INVENTION

Figure 1:
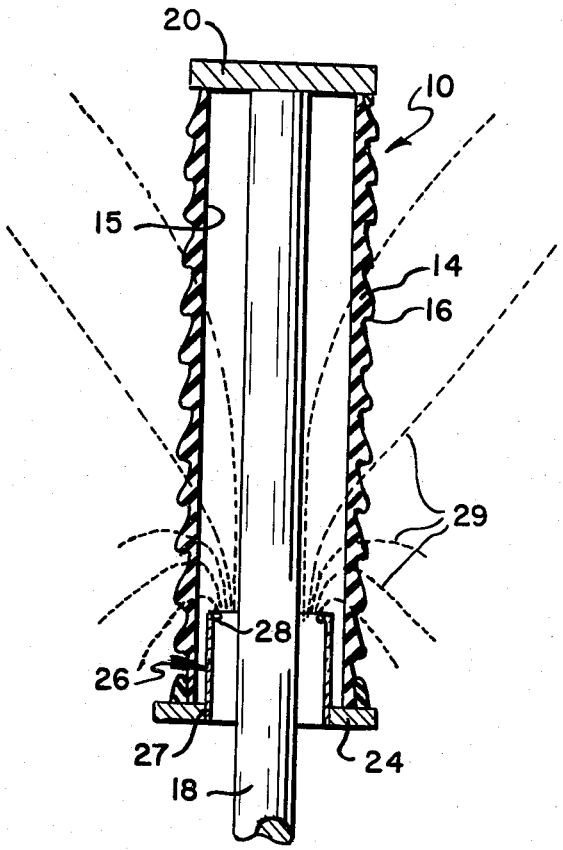
FIG 1 (PRIOR ART)
FIG. 1 shows a prior art high voltage electric bushing with equipotential electric field lines created during operation of the bushing.

Referring now to FIG. 1, a conventional high voltage bushing 10 comprises a hollow cylindrical body or weathershed 14 of epoxy, porcelain, ceramic, or the like high voltage insulator material, having an inner surface 15 and an outer surface 16. A central high voltage conductor 18 extends the length of the weathershed 14 and is disposed in the hollow interior thereof. A metallic end cap 20 which provides connection to a high voltage electrical system encloses one end of weathershed 14, and is connected to conductor 18. The other end of weathershed 14 receives support from metallic base member 24. Also supported by base member 24 is a metallic annular shield 26 which has a first end 27 connected to grounded base 24, and a second free end 28. Annular shield 26 is positioned to lie between conductor 18 and the inside wall 15 of weathershed 14, so as to prevent an electric field established by conductor 18 from concentrating at the open end of weathershed 14 adjacent base 24 which is operated at or near ground potential. Dashed lines 29 indicate equipotential electric field lines which appear on the outer surface 16 of weathershed 14 when conductor 18 is energized.

It can be seen from FIG. 1 that the region of highest electrical field appearing on the outer surface 16 of weathershed 14 is located adjacent the free end 28 of shield 26. Unless this region of high electrical field concentration is moderated, the weathershed will be subjected to the deleterious effects of electrical flashover and arcing which will appear along its outer surface 16. In extreme cases, such arcing is known to puncture the weathershed, resulting in catastrophic failure of the bushing.

Figure 2:
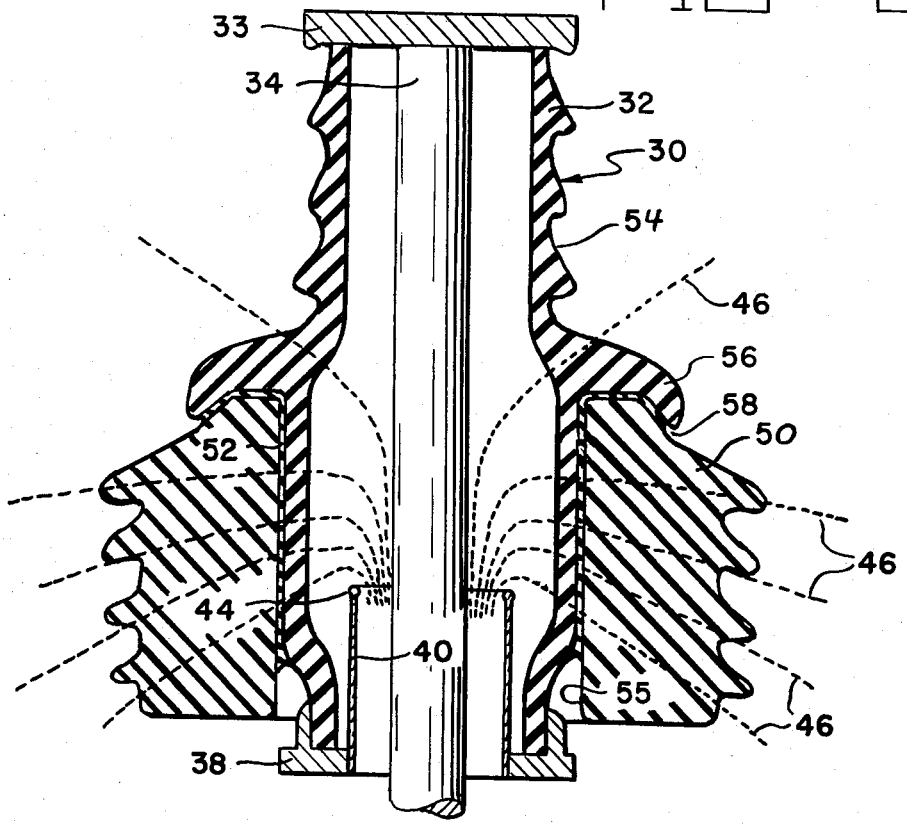
FIG. 2 shows a high voltage electric bushing constructed according to the invention, with equipotential electric field lines created during operation of the bushing.

Referring now to FIG. 2, a bushing 30 constructed according to the invention is shown comprising a hollow, generally cylindrical weathershed 32 which is enclosed at one end by metallic cap 33. High voltage conductor 34 is disposed within weathershed 32, and is connected at one end to cap 33. Metallic base member 38 supports the other end of weathershed 32. Grounded throat shield 40, having a free end 44, is connected to base 38. Shield 40 is disposed between conductor 34 and weathershed 32 to relieve electrical stress which would otherwise appear at points adjacent base 38. Equipotential electric field lines 46 are set up when conductor 34 is energized. It can be seen that a concentration of equipotential electric field lines 46 appears adjacent the free end 44 of shield 40. A collar or dielectric ring 50, formed of high voltage dielectric material, is inserted over one end of weathershed 32, adjacent base 38, and is secured thereto by an interface material 52, such as room temperature vulcanizing rubber. Interface material 52 also forms a watertight seal between an outer surface 54 of weathershed 32 and an interior surface 55 of dielectric ring 50 to prevent any breakdown between weathershed 32 and dielectric ring 50 which may be caused by moisture or other contamination entering therebetween, in the region of high electric field concentration. Skirt portion 56 of weathershed 32 shields the joinder or interface edge 58 of weathershed 32 and dielectric ring 50 from moisture-like contaminants which drip down the outer surface of weathershed 32.

Weathershed 32 is constructed according to present commercially advantageous production techniques, having a limited and generally constant thickness throughout its length. Stress relief of weathershed 32 is provided by dielectric ring 50, which has a greater thickness than the thickness of weathershed 32, preferably two to five times greater than the weathershed thickness adjacent the ring. When equipotential electric field lines 46 are made to pass outwardly through the relatively thick, or massive, portions of dielectric ring 50 they diverge, causing a reduced electric stress to appear on the outer surface of dielectric ring 50. Through the enhanced divergence of electric field lines provided by the dielectric ring 50 of the present invention, the maximum electric stress appearing on the outside surface of bushing 30 is significantly reduced, without requiring a prohibitively expensive weathershed of enlarged inner diameter, or enlarged thickness.

In the preferred embodiment, weathershed 32 is shown having a slightly enlarged inner diameter in the region of high electric field stress. This allows the equipotential electric field lines 46 to diverge slightly, before passing through the outside surface 54 of weathershed 32, thereby relieving electric stress on that surface. The enlarged inner diameter of weathershed 32 is, however, optional and is not required to practice the invention.

Figure 3:
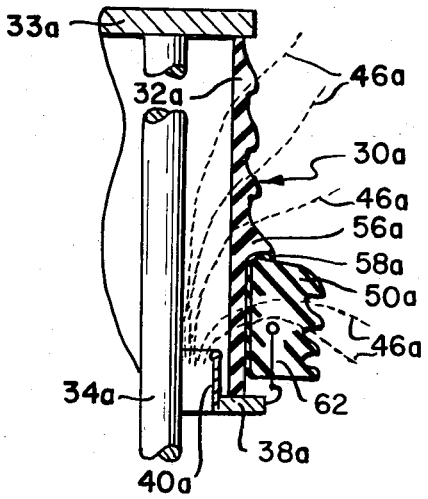
FIGS. 3 and 4 are fragmentary views of alternative embodiments of the bushing of FIG. 2.

Dielectric ring 50 may be formed of any suitable high voltage insulating material, preferably cast epoxy, to provide a lightweight, low-cost ring having high mechanical strength. When formed of cast epoxy, dielectric ring 50 can readily accommodate the additional stress relief means of FIGS. 3 and 5. Referring now to FIG. 3, a bushing **30*a* substantially identical to the bushing 30 of FIG. 2 is shown, having similar components similarly numbered but with a suffix "a". The embodiment of FIG. 3 differs from that of FIG. 2 in that a ground shield of ground ring 62 is cast within dielectric ring 50*a* to provide additional control of the electric stress on the outer surface of bushing 30*a*. Ground ring 62 further diverges equipotential electric field lines, and thereby relieves the external electrical stress in portions of dielectric ring 50*a* adjacent the grounded base 38*a*. While ground ring 62 is positioned radially outwardly of the central regions of bushing 30*a* where electric stress is concentrated, the axial position of that ground ring, relative to the region of high electric stress concentration, is preferably adjusted to complement the material compositions and relative thicknesses of the weathershed 32*a* and ring 50*a*, so as to achieve the desired stress pattern on the outer surface of bushing 30*a***.

Figure 4:
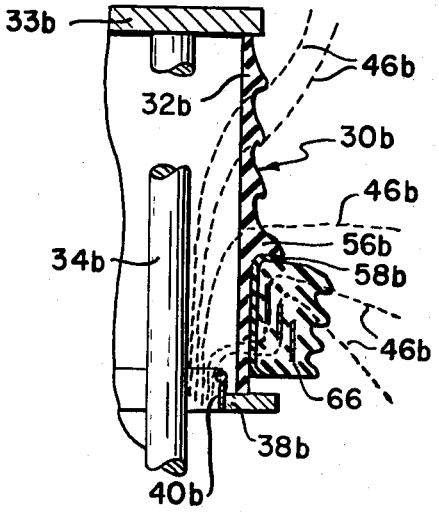

Referring now to FIG. 4, a bushing **30*b*, substantially identical to bushing 30 of FIG. 2, is shown having similar components similarly numbered but with a suffix "b". In this embodiment, capacitive shields or foils 66, not present in the embodiment of FIG. 2, are cast within dielectric ring 50*b*. The foils assume electric potentials determined by their capacitive coupling to each other, to the high voltage conductor, and to ground. The foils may be either of the grounded or the floating type. The length, overlap, the lateral separation of these foils in ring 50*b* are adjusted to control the capacitive grading of the electric field at the outer surface of bushing 30*b*, so as to provide a uniform electric field grading. When a lesser amount of control is required, dielectric ring 50*b*** could contain a single floating or grounded foil.

While the weathersheds of the various insulators are described above as generally cylindrical, it can be seen by those skilled in the art that this invention can be applied to bushings of other configurations. One popular variant of the cylindrical shape is the frustrum, or truncated cone. In prior art bushings of this type, the base is of a larger diameter and larger wall thickness (usually 1.5 to 2.0 times greater wall thickness) than top portions of the bushing. When compared with the increased overall thickness provided by the dielectric ring of the present invention, the walls of the frustrum-type bushing are "generally constant" throughout their length in that wall portions of increased thickness offer an insignificant stress relief advantage. In any event, the dielectric ring of the present invention, when applied to prior art bushing configurations, provides increased bushing thickness while maintaining the dimensions of those configurations constant.

The embodiments of the invention in which an exclusive property or privilege is claimed are defined as follows:

1. A high voltage bushing comprising:

a hollow weathershed having an outside surface and a first end;

a high voltage conductor disposed within said weathershed exerting a region of high electric field stress concentration on the outside surface of said weathershed;

means contacting the electric field for outwardly directing the concentration of high electric field stress to a predetermined portion of the outside surface of said weathershed; and a dielectric collar surrounding said predetermined portion of said weathershed, said collar having adjacent the region of high electric field stress concentration, a thickness substantially greater than the thickness of said weathershed, said collar further having an outside surface which forms a portion of the outside surface of said bushing; and means, separate from said collar, for supporting said weathershed, whereby the electric field stress concentration on the outside surface of said bushing is relieved.

2. The apparatus of claim 1 further comprising electric field stress relief means disposed in said collar for grading the electric field in which said collar is disposed.

3. The apparatus of claim 2, wherein said electric field stress relief means comprises an electrically conductive ring.

4. The apparatus of claim 2, wherein said electric field stress relief means comprises at least one electrically conductive shield capacitively coupled to said high voltage conductor.

5. The apparatus of claim 1, wherein said means for outwardly directing the concentration of high electric field stress comprises an electrically conductive shield disposed within said weathershed to surround said high voltage conductor.

6. The apparatus of claim 1 wherein said weathershed has a predetermined thickness adjacent the region of high electric field stress concentration, and said collar has a thickness between two and five times greater than said predetermined thickness of said weathershed.

7. The apparatus of claim 1 wherein said weathershed comprises a truncated cone, with said collar adjacent the base of said cone.

8. The apparatus of claim 1 further including means for sealing the joinder of said weathershed and said collar from contamination travelling along the outside surface of said weathershed.

9. The apparatus of claim 8, wherein said sealing means comprises a skirt integrally formed with said weathershed, said skirt overlying the joinder of said weathershed and said collar.

10. The apparatus of claim 8, further including an interface material between said weathershed and said collar, said interface material bonding said weathershed to said collar while preventing contamination from entering between said weathershed and said collar.

11. The apparatus of claim 10, wherein said interface material comprises room temperature vulcanizing rubber.

12. The apparatus of claim 1, wherein said collar is formed of cast epoxy.

* * * * *